US011282660B2

(12) United States Patent
Cheron et al.

(10) Patent No.: US 11,282,660 B2
(45) Date of Patent: Mar. 22, 2022

(54) ELECTROMECHANICAL ACTUATOR AND HIGH VOLTAGE (HV) SWITCH

(71) Applicants: Tyco Electronics UK Ltd., Swindon (GB); Carrier Kheops BAC, Allonnes (FR)

(72) Inventors: Herve Cheron, Le Mans (FR); Yves Cadoret, Le Mans (FR); Elizabeth Da Silva Domingues, Faringdon (GB); Thomas Moore, Marlborough (GB)

(73) Assignees: Tyco Electronics UK Ltd., Swindon (GB); Carrier Kheops BAC, Allonnes (FR)

( * ) Notice: Subject to any disclaimer, the term of this patent is extended or adjusted under 35 U.S.C. 154(b) by 0 days.

(21) Appl. No.: 17/078,449

(22) Filed: Oct. 23, 2020

(65) Prior Publication Data

US 2021/0043400 A1 Feb. 11, 2021

Related U.S. Application Data

(63) Continuation of application No. PCT/EP2019/060097, filed on Apr. 18, 2019.

(30) Foreign Application Priority Data

Apr. 25, 2018 (EP) ..... 18305516

(51) Int. Cl.
*H01H 9/04* (2006.01)
*H01H 33/24* (2006.01)
(Continued)

(52) U.S. Cl.
CPC ..... *H01H 33/24* (2013.01); *H01H 9/041* (2013.01); *H01H 33/42* (2013.01);
(Continued)

(58) Field of Classification Search
CPC ..... H01H 33/24; H01H 33/42; H01H 33/565; H01H 33/666; H01H 33/66238;
(Continued)

(56) References Cited

U.S. PATENT DOCUMENTS 4,256,938 A * 3/1981 Efinger ..... H02B 13/0354 200/302.3
5,808,258 A * 9/1998 Luzzi ..... H01H 33/66207 218/136
(Continued)

FOREIGN PATENT DOCUMENTS

AU 2009200952 B2 5/2014
CN 2924764 Y 7/2007
(Continued)

OTHER PUBLICATIONS

PCT Notification, Transmittal of the International Search Report and the Written Opinion, dated May 21, 2019, 17 pages.
(Continued)

*Primary Examiner* — William A Bolton
(74) *Attorney, Agent, or Firm* — Barley Snyder

(57) ABSTRACT

An electromechanical actuator includes an electrically insulating rod, an electrically insulating cover at least partly encompassing the electrically insulating rod, and an elastomeric diaphragm. The electrically insulating rod has a body, a first actuation portion connected to an electromechanical drive mechanism arranged in a first region, and a second actuation portion for actuating an electromechanical actuation mechanism arranged in a second region. The elastomeric diaphragm unit is arranged between the body and the cover. The elastomeric diaphragm unit has a flexible membrane electrically separating the first region from the second region. The elastomeric diaphragm unit is coated on at least one surface of the membrane with a semiconductive layer.

20 Claims, 4 Drawing Sheets

(51) Int. Cl.
*H01H 33/42* (2006.01)
*H01H 33/56* (2006.01)
*H01H 33/666* (2006.01)

(52) U.S. Cl.
CPC ..... *H01H 33/565* (2013.01); *H01H 33/666* (2013.01); *H01H 2033/426* (2013.01)

(58) Field of Classification Search
CPC ... H01H 2033/426; H01H 2033/66246; H01H 2033/66253
USPC ..... 218/1, 10, 118, 120, 134, 138, 139, 140, 218/135; 200/83 R
See application file for complete search history.

(56) References Cited

U.S. PATENT DOCUMENTS

| | | | | |
|---|---|---|---|---|
| 6,927,356 | B2 * | 8/2005 | Sato | H01H 33/666 218/154 |
| 7,285,743 | B2 * | 10/2007 | Martin | H01H 33/027 218/138 |
| 7,579,571 | B2 * | 8/2009 | Siebens | H01H 33/66207 200/308 |
| 8,674,254 | B2 * | 3/2014 | Borgstrom | H01H 33/42 218/136 |
| 2012/0193325 | A1 | 8/2012 | Borgstrom | |

FOREIGN PATENT DOCUMENTS

| | | | |
|---|---|---|---|
| CN | 101425423 | A | 5/2009 |
| CN | 101859662 | A | 10/2010 |
| CN | 101930870 | A | 12/2010 |
| CN | 102194602 | A | 9/2011 |
| CN | 202258992 | U | 5/2012 |
| CN | 105321766 | A | 2/2016 |
| EP | 0782162 | A2 | 7/1997 |
| EP | 2482301 | A1 | 8/2012 |
| EP | 2833387 | A1 | 2/2015 |
| GN | 201247723 | Y | 5/2009 |
| JP | H9-190748 | A | 7/1997 |
| JP | 2012-160450 | A | 8/2012 |
| RU | 2344506 | C1 | 1/2009 |
| WO | 2016045984 | A1 | 3/2016 |
| WO | 2017072117 | A1 | 5/2017 |

OTHER PUBLICATIONS

Japanese Notice of Reasons for Refusal, App No. 2021-506059, dated Nov. 24, 2021, 7 pages.
Chinese Office Action, App No. 201980027590.8, dated Dec. 3, 2021, 19 pages.

* cited by examiner

ELECTROMECHANICAL ACTUATOR AND HIGH VOLTAGE (HV) SWITCH

CROSS-REFERENCE TO RELATED APPLICATIONS

This application is a continuation of PCT International Application No. PCT/EP2019/060097, filed on Apr. 18, 2019, which claims priority under 35 U.S.C. § 119 to European Patent Application No. 18305516.9, filed on Apr. 25, 2018.

FIELD OF THE INVENTION

The present invention relates to high voltage switches and, more particularly, to an electromechanical actuator transmitting a mechanical movement.

BACKGROUND

For connecting and disconnecting high voltages, a control signal generated in a lower voltage (LV) environment has to be translated into a mechanical movement that actuates a switching device in a high voltage (HV) environment without endangering the low voltage environment by the high voltages. In particular, a safe galvanic separation has to be ensured between both environments.

Conventional high voltage switches have contacts that are located within an insulating environmental enclosure, such as a ceramic bottle. One of the contacts may be actuated by a mechanical system outside of the enclosure connected by a shaft extending through an enclosure seal. The actuating mechanisms typically form a ground connection in the switch and, unless precautions are taken, current may arc from the switch assembly to the actuating mechanism, causing failure or damage.

To address this, conventional high voltage switches, such as overhead re-closers, typically utilize a lengthy fiberglass pull rod to connect the actuating mechanism to the switch contact. The insulative fiberglass rod extends through an air filled cavity. However, this configuration takes a significant amount of physical space. Consequently, it is known from EP 2482301 A1 to provide an electrical switch comprising a tubular housing having a conductor receiving end and an operating end opposite the conductor receiving end, wherein the tubular housing includes an interface positioned intermediate the conductor receiving end and the operating end. An operating rod extends through the operating end toward the conductor receiving end, and a fixed contact electrically is coupled to the conductor receiving end.

A moveable contact is electrically coupled to the interface and the operating rod, wherein the moveable contact is moveable between a first position contacting the fixed contact and a second position separated from the fixed contact. A diaphragm is positioned in the tubular housing between the interface and the operating end to prevent voltage from the interface from arcing to the operating end. The diaphragm includes a bore therethrough for receiving the operating rod. The diaphragm includes a first tubular portion and a second tubular portion having an outside diameter smaller than an outside diameter of the first tubular portion, and a shoulder portion between the first tubular portion and the second tubular portion, wherein the first tubular portion is frictionally engaged with an inside of the tubular housing and the second tubular portion is frictionally engaged with the operating rod. Movement of the operating rod from the first position to the second position causes the second tubular portion to move relative to the first tubular portion, the movement deforming the shoulder portion.

This known arrangement, however, still has the problem that, under certain conditions, the electric field is not sufficiently managed so that electric discharges may occur that may damage the insulation material. Furthermore, the single diaphragm might not present a sufficient electrical insulation between the HV and the LV environment.

SUMMARY

An electromechanical actuator includes an electrically insulating rod, an electrically insulating cover at least partly encompassing the electrically insulating rod, and an elastomeric diaphragm. The electrically insulating rod has a body, a first actuation portion connected to an electromechanical drive mechanism arranged in a first region, and a second actuation portion for actuating an electromechanical actuation mechanism arranged in a second region. The elastomeric diaphragm unit is arranged between the body and the cover. The elastomeric diaphragm unit has a flexible membrane electrically separating the first region from the second region. The elastomeric diaphragm unit is coated on at least one surface of the membrane with a semiconductive layer.

BRIEF DESCRIPTION OF THE DRAWINGS

The invention will now be described by way of example with reference to the accompanying Figures, of which.

DETAILED DESCRIPTION OF THE EMBODIMENT(S)

The accompanying drawings are incorporated into the specification and form a part of the specification to illustrate several embodiments of the present invention. These drawings, together with the description, serve to explain the principles of the invention. The drawings are merely for the purpose of illustrating examples of how the invention can be made and used, and are not to be construed as limiting the invention to only the illustrated and described embodiments. Furthermore, several aspects of the embodiments may form—individually or in different combinations—solutions according to the present invention. The following described embodiments thus can be considered either alone or in an arbitrary combination thereof. Further features and advantages will become apparent from the following more particular description of the various embodiments of the invention, as illustrated in the accompanying drawings, in which like references refer to like elements.

The present invention may be used with high-voltage switches such as e. g. vacuum breakers, in particular for 42 kV applications. The term "high-voltage" as used in the following is intended to relate to voltages above approximately 1 kV. In particular, the term high-voltage is intended to comprise the usual nominal voltage ranges of power transmission, namely medium voltage, MV, (about 3 kV to about 72 kV), high-voltage, HV, (about 72 kV to about 245 kV), and also extra high-voltage (up to presently about 500 kV). Of course also higher voltages may be considered in the future. These voltages may be direct current (DC) or alternating current (AC) voltages. In the following, the term "high-voltage cable" is intended to signify a cable that is suitable for carrying electric current of more than about 1 A at a voltage above approximately 1 kV. Accordingly, the term "high-voltage switch" is intended to signify a device that is suitable for connecting and disconnecting high-voltage facilities and/or high-voltage cables. The present invention provides means for safely transmitting a mechanical movement from the so-called "low-voltage", LV, environment that relates to voltages below 1 kV to the HV environment. Of course, instead of an LV environment, the first environment may also be ground potential.

Figure 1:
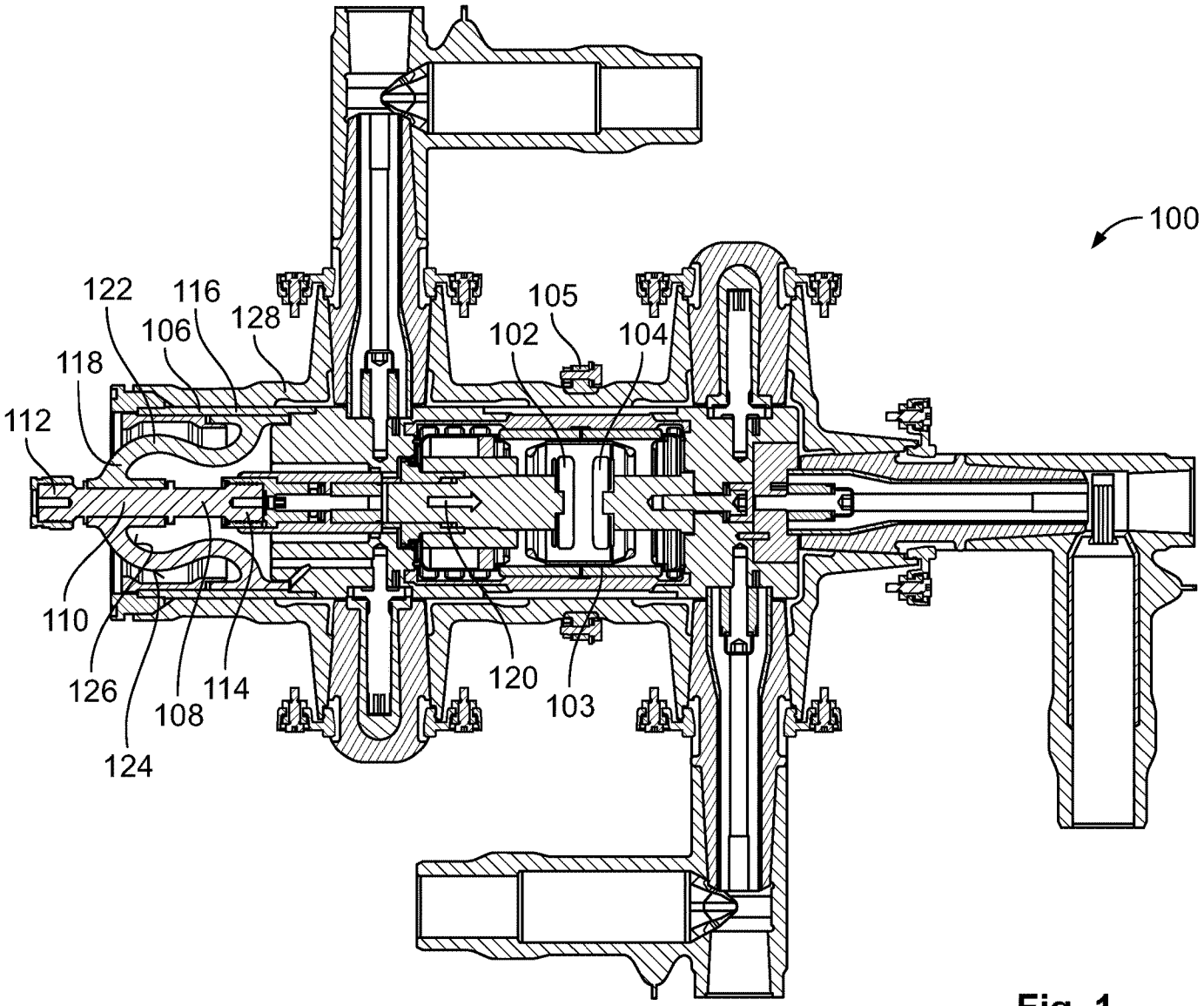
FIG. 1 is a sectional side view of a high-voltage switch according to an embodiment.

A high-voltage switch 100 according to an embodiment is shown in FIG. 1. On a high voltage (HV) side of the high-voltage switch 100, a first electrical contact 102 can be connected to a second electrical contact 104. In FIG. 1, these two contacts 102, 104 are shown in a disconnected state. For closing the electrical connection, the electrical contact 102 has to be moved in a direction indicated by arrow 120 towards the electrical contact 104. According to the present invention, this is done by an actuator 106. The first and second electrical contacts 102, 104 may be encased in a vacuum case 103, also referred to as a bottle. In an embodiment, the high-voltage switch 100 is a vacuum circuit breaker.

The actuator 106, as shown in FIG. 1, comprises an electrically insulating rod 108 with a body 110, a first actuation portion 112 for being connected to an electromechanical drive mechanism, and a second actuation portion 114 for actuating an electromechanical actuation mechanism which is arranged in an HV region. The first actuation portion 112 is arranged in a low-voltage (LV) environment or is connected to ground (also referred to as the "earth side"). An electrically insulating cover 116 at least partly encompasses the electrically insulating rod 108.

The actuator 106, as shown in FIG. 1, includes an elastomeric diaphragm unit 118, which is arranged between the electrically insulating body 110 and the cover 116, and has a flexible membrane 122 for electrically separating a first and second region. The elastomeric diaphragm unit 118 separates the HV region and the LV environment.

According to the present invention, the diaphragm unit 118 is coated on at least one of the surfaces 124, 126 of the membrane 122 with a semiconductive layer having static dissipative or static shielding properties. For instance, a polymer containing carbon black may be used for such a semiconducting layer. Any other suitable material that exhibit the necessary highly resistive conductivity for reducing static charges may of course also be used. Thereby, the HV electrical field can be optimally managed and damaging of the insulating material of the flexible membrane 122 can be avoided.

The cover 116 is formed from a solid electrically insulating tube. On the outside, it is covered by a flexible insulating layer 128, as shown in FIG. 1, which is for instance fabricated from silicone. The insulating layer 128 may be covered by a semi-conductive outer layer. In order to quickly discharge a flash-over in the region of the electrical contacts 102, 104, a grounding contact 105 is provided which is connected to ground. In an embodiment, the cover 116 is formed separate from the diaphragm unit 118, which allows the actuator 106 to be built into a plurality of different switch types by only modifying the tube so as to fit into the housing of the particular switch. The cover 116 is attached to an enclosure enclosing the HV region, so that the membrane 122 effectively seals the HV environment.

The membrane 122 is flexible and therefore allows the rod 108 to move along the longitudinal direction 120 and back again, thereby deflecting the membrane 122. On the other hand, the electrically insulating flexible membrane 122 provides an effective electrical insulation between the HV side and the LV side (or ground).

Figure 2:
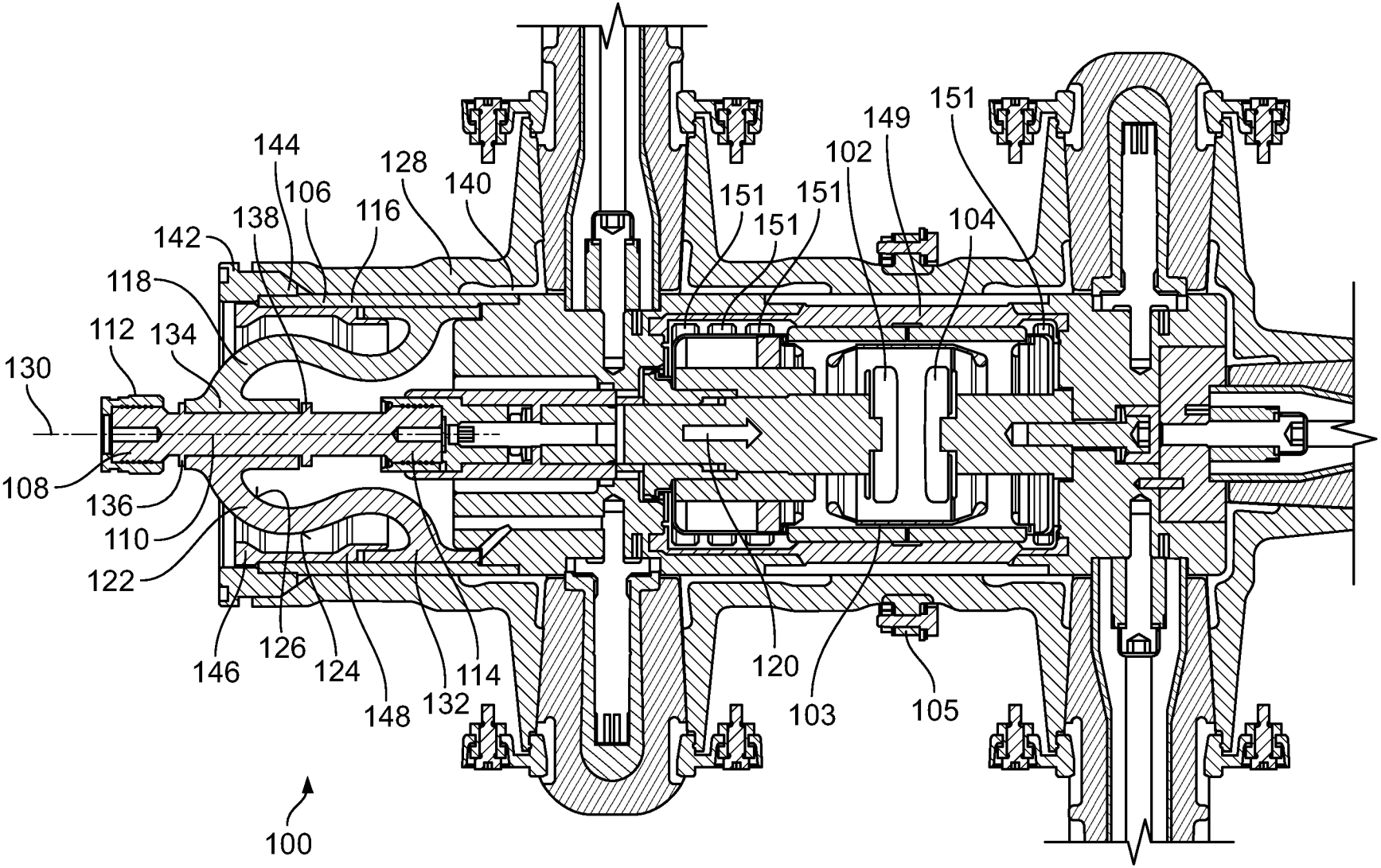
FIG. 2 is a detail view of a portion of FIG. 1.

FIG. 2 illustrates the actuator 106 in more detail. As shown in FIG. 2, the rod 108 has a longitudinal axis 130 which runs along the movement direction 120. In order to safely anchor the diaphragm unit 118 at the inside of the tube shaped cover 116, the diaphragm unit 118 comprises an outer sleeve 132 arranged at the cover 116 in a sealing manner. Furthermore, for mechanically contacting the electrically insulating rod 108, the diaphragm unit 118 has an inner sleeve 134 which encompasses the body 110 of the electrically insulating rod 108 in a sealing manner. The inner sleeve 134 safely avoids any electrical currents exiting the HV environment along the rod 108. In an embodiment, the body 110 of the rod 108 has an elongated essentially cylindrical shape along the longitudinal axis 130.

In order to avoid that the inner sleeve 134 slides along the outer surface of the body 110, when the rod 108 is moved, two ring-shaped fixing elements 136, 138 shown in FIG. 2 are provided around a circumference of the rod 108. Thereby, the inner sleeve 134 is mechanically fixed in a longitudinal direction on both sides. It is clear for a person skilled in the art, that these ring-shaped protrusions 136, 138 may of course also be replaced by fixing elements that cover only a part of the circumference of the rod's body 110. The ring-shaped solution according to the shown embodiment enhances the creepage distance for any electrical currents. The ring-shaped protrusions 136, 138 are spaced apart along the longitudinal axis 130 corresponding to a longitudinal dimension of the inner sleeve 134.

As shown in FIG. 2, the silicone cover 128 may also be provided with a semiconductive layer 140 that provides an electrical field control and acts as a Faraday cage. A grounding contact 105 allows for a fast discharge of a flash-over in the region of the electrical contacts 102, 104.

Figure 3:
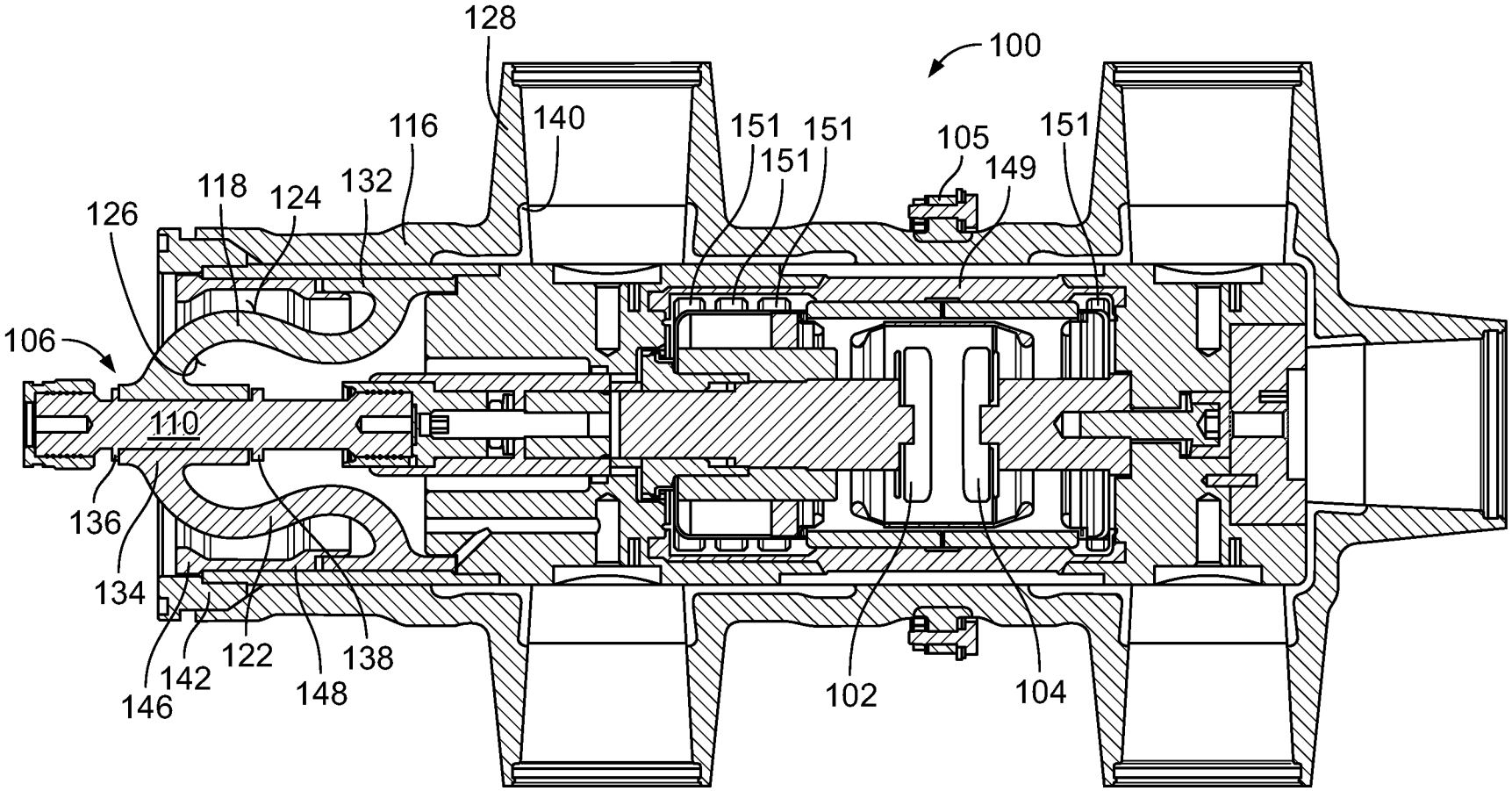
FIG. 3 is a sectional side view of the high-voltage switch of FIG. 1 without attached connectors.

As shown in FIGS. 2 and 3, for securing the actuator 106 at the remainder of the switch, two caps may be provided. In particular, an outer cap 142, which has an essentially tubular shape and a tapered region 144, can be inserted between the cover 116 and the silicone layer 128 in order to safely secure the cover 116 at the switch 100. In order to mechanically fix the outer sleeve 132 of the diaphragm unit 118 inside the cover 116, an inner tube shaped cap 146 is inserted between the cover 116 and the free space needed for the deflected membrane 122. A retention shoulder 148 interacts with the outer sleeve 132 for fixing the sleeve 132 in a longitudinal direction.

According to the present invention, the first surface 124 as well as the second surface 126 of the membrane 122 are covered with a semi-conductive layer for managing the HV electrical field.

The vacuum case 103 may be surrounded by an electrically insulating fluid, such as an oil or a gel filling 149 for better electrical insulation. In order to control and limit the occurring pressure of the gel 149 (in particular under elevated temperatures), the HV switch 100 has pressure limiters with one or more air reservoirs 151. In contrast to the gel, the air is compressible and can therefore balance the pressure. In other embodiments, the electrical contacts 102, 104 may be enclosed in any electrically insulating enclosure that forms a compartment filled with an insulating fluid. The pressure limiter(s), such as the air reservoirs 151 within the compartment, may be fabricated at least partly from a semiconductive material, thereby improving the electrical field distribution.

FIG. 3 illustrates the HV switch 100 according to the present invention without the attached various connectors.

Figure 4:
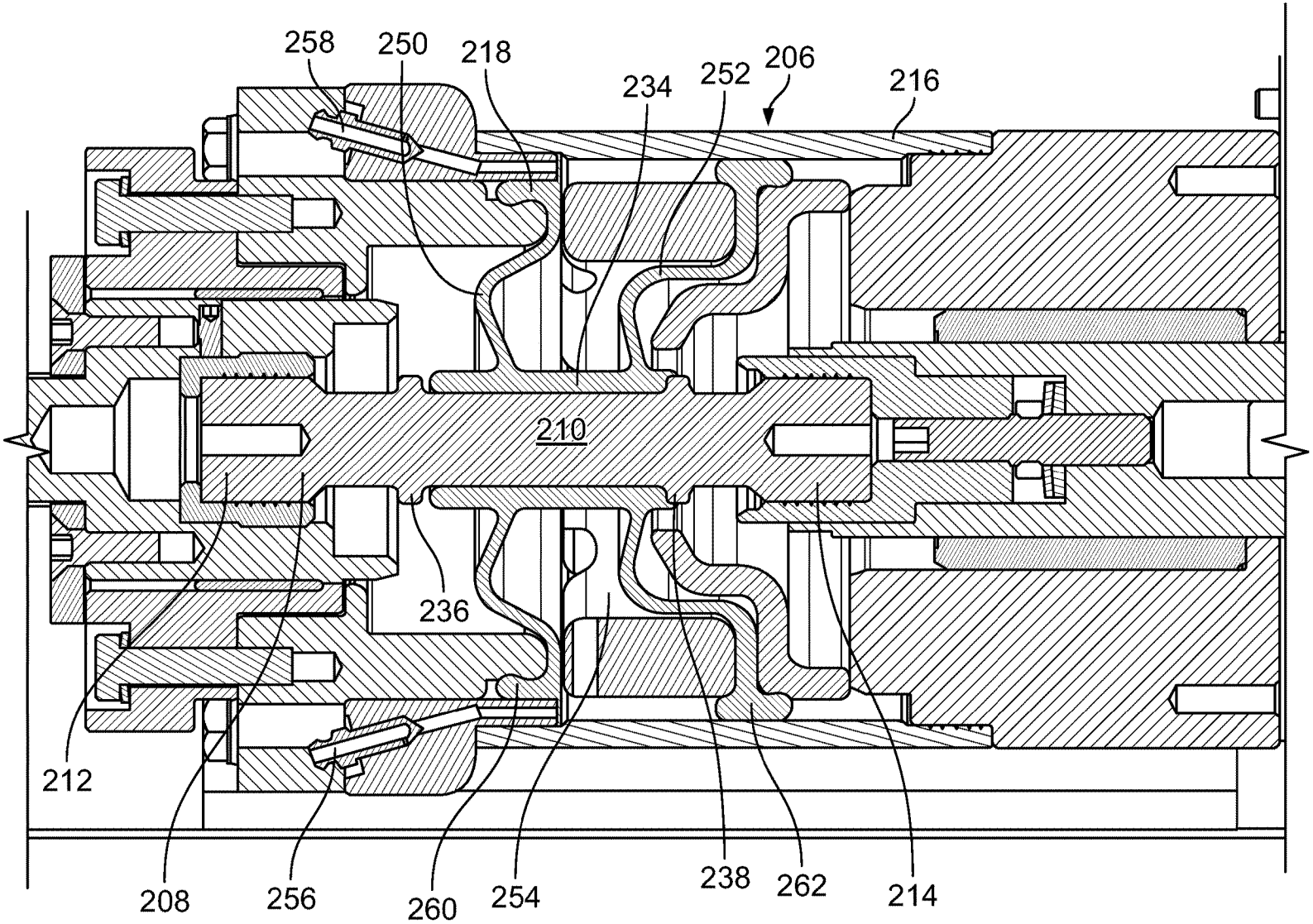
FIG. 4 is a detail sectional side view of a high-voltage switch according to another embodiment.

FIG. 4 illustrates a further advantageous embodiment of an actuator 206 according to the present invention. According to this embodiment, the rod 208 is essentially the same as the rod 108 of the previous figures. The rod 208 has a body 210 and a first actuation portion 212 and the second actuation portion 214. The actuator 206 further comprises a cover 216 which is fabricated as an essentially tubular electrically insulating part. The body 210 of the rod 208 has two essentially ring-shaped protrusions 236, 238 which engage with an inner sleeve 234 of a diaphragm unit 218.

Different from the previous embodiments, the diaphragm unit 218 comprises a first membrane 250 and a second membrane 252 distanced apart from one another along a longitudinal axis of the rod 208, as shown in FIG. 4. Those membrane 250, 252 are thinner than the membrane 122 shown in FIGS. 1-3 and are therefore more flexible and can be deflected more easily. In another embodiment, more than two membranes 250, 252 can be provided resulting in a still higher quality of the electrical insulation.

The first membrane 250 and the second membrane 252 enclose a compartment 254 between each other, as shown in FIG. 4. According to the present invention, this compartment 254 may be filled with an electrically insulating fluid, for instance a dielectric oil. Of course any other suitable material, such as silicon gel or an insulating powder may also be employed in the compartment 254. An inlet 256 is provided for filling in the oil and an outlet or venting element 258 may serve for venting the compartment 254, allowing pressure compensation of the electrically insulating fluid in order to avoid dangerous overpressure. The inlet 256 may, for instance, comprise an oil filling screw with a lead through that is connected to the compartment 254.

The first and second membranes 250, 252 may either be integrally formed with one common inner sleeve 234 and/or one common outer sleeve 260, 262. In the embodiment shown in FIG. 4, each of the membranes 250, 252 has its separate outer sleeve 260, 262 which is attached to the cover 216 in a sealing manner. A first outer sleeve 260 is connected to the first membrane 250 and a second outer sleeve 262 is connected to the second membrane 262. At least one of the membranes 250, 252 is coated with a semiconductive layer on at least one of its surfaces in order to provide an optimal management of the HV electrical field.

The embodiment shown in FIG. 4 has the advantage that the membranes 250 and 252 can be fabricated with much thinner walls compared to the membrane 122 of FIG. 1-3, so that they can be deflected more easily and the actuator 206 requires lower forces for moving the rod 208. The oil filling of the compartment 254 significantly enhances the electrical insulation quality.

The actuator 106 transmits a mechanical movement from the first region into the second region, the first and the second region being galvanically separated from each other, which ensures safe galvanic separation, is long term stable and robust, and can be fabricated in an economic manner.

What is claimed is:

1. An electromechanical actuator, comprising:

an electrically insulating rod having a body, a first actuation portion for connecting to an electromechanical drive mechanism arranged in a first region, and a second actuation portion for actuating an electromechanical actuation mechanism arranged in a second region;

an electrically insulating cover at least partly encompassing the electrically insulating rod; and an elastomeric diaphragm unit arranged between the body and the cover, the elastomeric diaphragm unit having a flexible membrane electrically separating the first region from the second region, the elastomeric diaphragm unit is coated on a pair of surfaces of the membrane with a semiconductive layer.

2. The electromechanical actuator of claim 1, wherein the cover is an electrically insulating tube formed separately from the elastomeric diaphragm unit.

3. The electromechanical actuator of claim 1, wherein the elastomeric diaphragm unit has an inner sleeve arranged at the body in a sealing manner.

4. The electromechanical actuator of claim 3, wherein the body has an elongated essentially cylindrical shape with a longitudinal axis.

5. The electromechanical actuator of claim 4, wherein the body has a fixing element fixing the inner sleeve at the body.

6. The electromechanical actuator of claim 5, wherein the body has a pair of ring-shaped protrusions spaced apart along the longitudinal axis corresponding to a longitudinal dimension of the inner sleeve, the inner sleeve is held between the ring-shaped protrusions.

7. The electromechanical actuator of claim 3, wherein the elastomeric diaphragm unit has an outer sleeve arranged at the cover in a sealing manner.

8. The electromechanical actuator of claim 1, wherein the diaphragm unit includes a first membrane and a second membrane distanced apart from one another along a longitudinal axis of the rod.

9. The electromechanical actuator of claim 8, wherein the first membrane and the second membrane form a compartment between each other.

10. The electromechanical actuator of claim 8, wherein the diaphragm unit includes a first outer sleeve and a second outer sleeve arranged at the cover in a sealing manner.

11. The electromechanical actuator of claim 10, wherein the first outer sleeve is connected to the first membrane and the second outer sleeve is connected to the second membrane.

12. An electromechanical actuator, comprising:

an electrically insulating rod having a body, a first actuation portion for connecting to an electromechanical drive mechanism arranged in a first region, and a second actuation portion for actuating an electromechanical actuation mechanism arranged in a second region;

an electrically insulating cover at least partly encompassing the electrically insulating rod; and an elastomeric diaphragm unit arranged between the body and the cover, the elastomeric diaphragm unit having a flexible membrane electrically separating the first region from the second region and including a first membrane and a second membrane distanced apart from one another along a longitudinal axis of the rod and forming a compartment therebetween, wherein the compartment is filled with an electrically insulating fluid.

13. The electromechanical actuator of claim 12, wherein the compartment has an inlet for filling in the insulating fluid.

14. The electromechanical actuator of claim 12, wherein the diaphragm unit has a venting element allowing pressure compensation of the electrically insulating fluid.

15. A high voltage switch, comprising:

a first region;

a second region;

an electromechanical actuator including an electrically insulating rod, an electrically insulating cover at least partly encompassing the electrically insulating rod, and an elastomeric diaphragm, the electrically insulating rod having a body, a first actuation portion for connecting to an electromechanical drive mechanism arranged in the first region, and a second actuation portion for actuating an electromechanical actuation mechanism arranged in the second region, the elastomeric diaphragm unit arranged between the body and the cover, the elastomeric diaphragm unit having a flexible membrane electrically separating the first region from the second region; and a first electrical contact and a second electrical contact enclosed in an electrically insulating enclosure, the enclosure forms a compartment filled with an insulating fluid and a pressure of the insulating fluid is controlled by a reservoir.

16. The high voltage switch of claim 15, wherein the cover is attached to an enclosure enclosing the high voltage environment.

17. The high voltage switch of claim 15, wherein the reservoir is an air reservoir arranged within the compartment.

18. The high voltage switch of claim 15, wherein the electromechanical actuator transmits a mechanical movement from the first region into the second region.

19. An electromechanical actuator, comprising:

an electrically insulating rod having a body, a first actuation portion for connecting to an electromechanical drive mechanism arranged in a first region, and a second actuation portion for actuating an electromechanical actuation mechanism arranged in a second region;

an electrically insulating cover at least partly encompassing the electrically insulating rod;

an elastomeric diaphragm unit arranged between the body and the cover, the elastomeric diaphragm unit having a flexible membrane electrically separating the first region from the second region; and a cap inserted between the electrically insulating cover the elastomeric diaphragm unit for fixing the position of the elastomeric diaphragm unit relative to the electrically insulating cover in a longitudinal direction.

20. The electromechanical actuator of claim 19, wherein the cap includes a retention shoulder receiving an outer sleeve of the elastomeric diaphragm unit.

* * * * *